US007100484B2

(12) United States Patent
Maddalon

(10) Patent No.: US 7,100,484 B2
(45) Date of Patent: Sep. 5, 2006

(54) APPARATUS FOR AUTOMATICALLY TRIMMING AND CUTTING IMAGES ON SHEETS OF PAPER AND OTHER GRAPHIC AND PHOTOGRAPHIC SUPPORTS

(75) Inventor: Valter Maddalon, Pralungo (IT)

(73) Assignee: Fotoba International S.r.l., Quaregna (IT)

( * ) Notice: Subject to any disclaimer, the term of this patent is extended or adjusted under 35 U.S.C. 154(b) by 0 days.

(21) Appl. No.: 10/818,426

(22) Filed: Apr. 5, 2004

(65) Prior Publication Data

US 2004/0182211 A1 Sep. 23, 2004

Related U.S. Application Data

(63) Continuation of application No. PCT/IT02/00677, filed on Oct. 24, 2002.

(30) Foreign Application Priority Data

Oct. 24, 2001 (IT) ..... MI2001A2234

(51) Int. Cl.

| | |
|---|---|
| ***B26D 5/34*** | (2006.01) |
| ***B26D 7/01*** | (2006.01) |
| ***B26D 7/26*** | (2006.01) |
| ***B26D 11/00*** | (2006.01) |
| ***G03D 15/04*** | (2006.01) |

(52) U.S. Cl. ..... 83/74; 83/76.8; 83/215; 83/256; 83/364; 83/365; 83/367; 83/368; 83/404; 83/419; 83/421; 83/436.3; 83/468.2; 83/468.6; 83/468.7

(58) Field of Classification Search ..... 83/255, 83/256, 404, 404.1, 404.2, 404.3, 33–36, 83/72, 74, 76.8, 209–211, 215, 360, 364, 83/365, 367, 368, 370, 371, 418, 419, 421, 83/436.3, 436.7, 467.1, 468.1, 468.2, 468.3, 83/468.6, 468.7, 948

See application file for complete search history.

(56) References Cited

U.S. PATENT DOCUMENTS

| | | | | |
|---|---|---|---|---|
| 1,841,426 | A * | 1/1932 | Balletti | 83/106 |
| 3,199,450 | A * | 8/1965 | Leavens | 101/211 |
| 3,443,867 | A * | 5/1969 | Scheffel | 355/29 |
| 3,640,235 | A * | 2/1972 | Burton | 112/470.36 |
| 3,688,619 | A * | 9/1972 | Yabuta | 83/35 |
| 3,722,435 | A * | 3/1973 | Elsas | 112/470.05 |
| 3,772,948 | A * | 11/1973 | Burton | 83/23 |
| 3,915,039 | A * | 10/1975 | Schoppee | 83/864 |

(Continued)

FOREIGN PATENT DOCUMENTS

EP 0 951 973 A1 10/1999

(Continued)

*Primary Examiner*—Clark F. Dexter
(74) *Attorney, Agent, or Firm*—Akin Gump Strauss Hauer & Feld, LLP

(57) ABSTRACT

Apparatus for automatically trimming and cutting images on support sheets, which comprises two cutting devices (1, 2) arranged upstream and downstream, respectively, a conveying device (3) which is suitable for conveying to the second cutting device (2) the sheet portions cut by the first cutting device (1) and comprises one or more conveyor belts (12) tight between a pair of rollers (13), at least one being mechanically connected to a motor (14), a plurality of sensors (16, 17, 18) suitable for detecting the presence of a sheet portion on the conveyor belts (12), as well as one or more conveying rollers (25) suitable for taking a sheet portion placed on the conveyor belts (12) and conveying it to the second cutting device (2).

8 Claims, 3 Drawing Sheets

U.S. PATENT DOCUMENTS 4,041,818 A * 8/1977 Rummer ..... 83/256
4,506,824 A * 3/1985 Bartz ..... 234/28
4,641,555 A * 2/1987 Johnson et al. ..... 83/29
5,079,981 A * 1/1992 Singer et al. ..... 83/72
5,120,290 A * 6/1992 Bay ..... 493/14
5,360,161 A * 11/1994 Schaller et al. ..... 234/42
5,365,817 A * 11/1994 Maeda et al. ..... 83/256
5,397,106 A * 3/1995 Hill ..... 270/58.34
5,586,479 A * 12/1996 Roy et al. ..... 83/74
5,597,156 A 1/1997 Claassen
5,815,761 A * 9/1998 Haruta et al. ..... 396/567
5,887,503 A * 3/1999 Kataigi et al. ..... 83/106
6,164,640 A 12/2000 Stengl et al.
6,181,409 B1 * 1/2001 Calhoun ..... 355/39
6,196,098 B1 * 3/2001 Hagiwara et al. ..... 83/79
6,820,526 B1 * 11/2004 Maddalon ..... 83/76.8
2003/0131702 A1 * 7/2003 Sauer et al. ..... 83/23

FOREIGN PATENT DOCUMENTS

WO WO 01/76833 A1 10/2001

* cited by examiner

APPARATUS FOR AUTOMATICALLY TRIMMING AND CUTTING IMAGES ON SHEETS OF PAPER AND OTHER GRAPHIC AND PHOTOGRAPHIC SUPPORTS

CROSS-REFERENCE TO RELATED APPLICATIONS

This application is a continuation of International Application No. PCT/IT02/00677, filed Oct. 24, 2002 and the disclosure of which is incorporated herein by reference.

BACKGROUND OF THE INVENTION

The present invention relates to an apparatus for automatically trimming and cutting images on sheets of paper and other graphic and photographic supports, and in particular images, also with different formats, arranged on said sheets along several rows and columns.

U.S. Pat. No. 5,586,479 to Roy et al. discloses an apparatus for trimming and cutting images of the same format arranged on a sheet of photographic paper along several rows and columns parallel to each other, but not necessarily parallel to the edges of the same sheet. This known apparatus comprises two cutting devices arranged perpendicular to each other upstream and downstream, respectively, of a conveying device which aligns the strips of images coming from the first cutting device before sending them to the second cutting device. However, in this known apparatus the sheet to be cut must be carefully guided, since if it is not conveyed with the edges arranged perfectly parallel to the feed direction, the images can be not precisely cut along their edges. For avoiding this drawback, the patent applications EP 951973 and PCT/IT01/00131 of the same applicant disclose two cutting devices wherein the sheet to be cut can be inserted and/or conveyed with the edge not necessarily parallel to the feed direction, even when the same sheet is very large. However, these known cutting devices can cut the images from the sheet only along one axis, so that a manual intervention is necessary when the images are arranged along several rows and columns.

BRIEF SUMMARY OF THE INVENTION

Therefore, an object of the present invention is to provide a cutting apparatus which is free from the drawbacks of the above mentioned known apparatus, i.e. a cutting apparatus which can automatically cut sheets which are not perfectly aligned as in the above mentioned known cutting devices. Said object is achieved with a trimming and cutting apparatus, the main features of which are disclosed in the first claim and other features are disclosed in the following claims.

The apparatus according to the present invention, thanks to the particular conveying device which is provided with, allows to arrange upstream and downstream of this conveying device two cutting devices suitable for precisely cutting images arranged along several rows and columns on sheets also having the edges not perfectly aligned to their feed direction, so as to obtain, always and in a completely automatic manner, images perfectly cut along their edges.

Furthermore, the conveying device of the apparatus according to the present invention, thanks to its mobile stops, allows to automatically handle sheet portions with different formats, thereby discarding, if necessary, the portions which are too big for the second cutting device. With this arrangement, it is possible to precisely cut the images arranged on several rows and columns, even when they have different sizes, always keeping their sequence order.

Another advantage of the apparatus according to the present invention lies in its high speed obtained thanks to the possibility of handling sheets with the edges not perfectly aligned to their feed direction even when they are going to be cut by the cutting devices.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
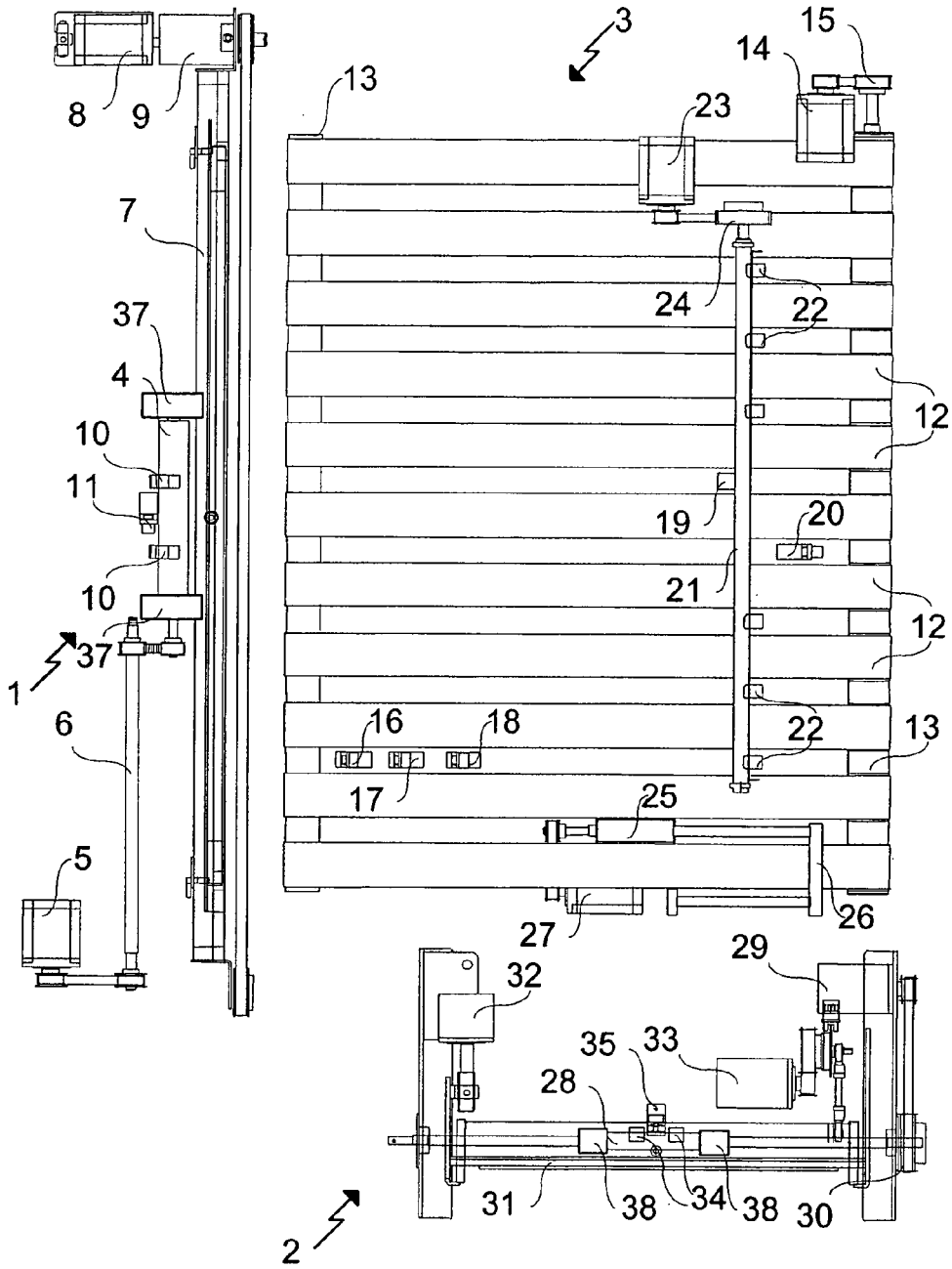
FIG. 1 shows a schematic top view of the apparatus according to said embodiment.

Referring to FIG. 1, it is seen that the apparatus according to the present invention comprises in a known way two cutting devices 1, 2 arranged perpendicular to each other upstream and downstream, respectively, a device 3 for conveying the portions of a sheet, in particular a graphic or photographic support, which are cut and ejected by the first cutting device 1. The conveying device 3 can align these portions before conveying them to the second cutting device 2, which provides for cutting them in several further portions.

In particular, the cutting device 1 can comprise in a known way one or more conveying rollers 4 which can be rotated by a motor 5 by means of a transmission system 6 for conveying a sheet to be cut (not shown in the figure) to a cutting mechanism 7 arranged substantially parallel to the rotation axis of rollers 4. However, the cutting mechanism 7 is pivoted for rotating around a vertical axis Y and thus for being arranged slightly slantwise with respect to the rotation axis of rollers 4 by a motor 8, for instance by means of an endless screw. The cutting mechanism 7 is further provided with a motor 9 for driving a mobile blade suitable for cutting the sheets conveyed by rollers 4. At least one pair of sensors 10 suitable for locating one or more marks printed on the sheet to be cut, in particular optical sensors suitable for locating barcodes printed with the bars parallel to the cut lines, is arranged close to rollers 4. Electronic calculation means (not shown in the figure) process the signals transmitted by sensors 10 and send corresponding control signals to motor 8 for arranging the cutting mechanism 7 parallel to the cut lines. If the sheet to be cut is very wide, the cutting device 1 can be also provided with encoders 37 suitable for detecting and correcting in the cutting mechanism 7 possible displacements of the sheet before the cut but after sensors 10 have detected the marks thereon. Finally, the cutting device 1 can also be provided with a sensor 11 for detecting the presence of the sheet to be cut close to rollers 4.

According to the invention, the conveying device 3, which comprises one or more conveyor belts 12 tight between a pair of rollers 13, at least one connected to a motor 14 by means of a transmission system 15, is arranged downstream the cutting device 1. The rotation axis of rollers 13 of the conveying device 3 is preferably parallel to the axis of rollers 4 of the cutting device 1. A plurality of sensors, in particular five sensors 16, 17, 18, 19, 20 suitable for detecting the presence of a sheet portion coming from the cutting device 1, is arranged at different distances from the latter between two belts 12. A bar 21 provided with one or more stops 22 is arranged close to the fourth sensor 19 and can be rotated by a motor 23 through a transmission system 24 for arranging stops 22 perpendicular, parallel or slantwise with respect to belts 12, so as to obtain different stop points for the sheet portions conveyed by belts 12, or not stopping them at all and continuing their feeding up to the end of belts 12 at the end of the conveying device 3. For this purpose, the free end of stops 22 is shaped for allowing a secure stop of the sheet portion even when they are slanted forwards. One or two conveying rollers 25, horizontal and preferably perpendicular to rollers 13, are suitably arranged between belts 12, in particular in the free space comprised between the two belts 12 closest to the cutting device 2. The conveying rollers 25 are mounted on mobile supports 26 and can be translated and rotated by at least one motor 27 by means of a transmission system integral with the mobile supports 26. The latter, when motor 27 is working, translate the shafts of rollers 25 so as to bring them near to each other for lifting, taking and transporting a sheet portion placed on belts 12.

For arranging said sheet portion substantially in the middle of the cutting device 2, sensors 16, 17, 18 send to electronic calculation means (not shown in the figure) signals according to the presence of this portion above them. Said electronic calculation means determine, according to the signal received from sensors 16, 17, 18, the width of the sheet portion and then send a control signal to motor 23, which moves stops 22 by rotating bar 21 so that the sheet portion is conveyed by belts 12 until it does not hit against stops 22.

Sensors 19 and/or 20 detect and signal the presence of the sheet portion stopped by stops 22 to said electronic calculation means, which, once these signals are received, send a control signal to motor 27 for mutually drawing up and rotating rollers 25 with opposite rotating directions, so as to lift and take the portion for transporting it to the cutting device 2.

Also the cutting device 2, as the cutting device 1, can comprise in a known way one or more conveying rollers 28 which can be rotated by a motor 29 by means of a transmission system 30 for conveying the sheet portion coming from the conveying device 3 to a cutting mechanism 31, preferably pivoted for rotating around a vertical axis Y and therefore for being arranged, if necessary, slightly slantwise with respect to the rotation axis of rollers 28 by a motor 32, for instance by means of an endless screw. The cutting mechanism 31 is provided with a motor 33 for driving a mobile blade suitable for cutting the sheet portions conveyed by rollers 28. At least one pair of sensors 34 suitable for locating the marks printed on the sheet portion to be cut is arranged close to rollers 28. Electronic calculation means (not shown in the figure) process the signals transmitted by sensors 34 and send corresponding control signals to motor 32 for arranging the cutting mechanism 31 perfectly parallel to the cut lines. If the sheet portion to be cut is very wide, the cutting mechanism 2 can be also provided with encoders 38 suitable for detecting and correcting in the cutting mechanism 31 possible displacements before the cut but after sensors 34 have detected the marks. Finally, the cutting device 2 can also be provided with a sensor 35 for detecting the presence of the sheet portion to be cut close to rollers 28.

Devices 1 and 2 can consist of a cutting device for wide sheets as the one described in the application PCT/IT01/00131, or of a cutting device for smaller sheets, for instance strips of images, as the one described in the application EP 951973.

Figure 2:
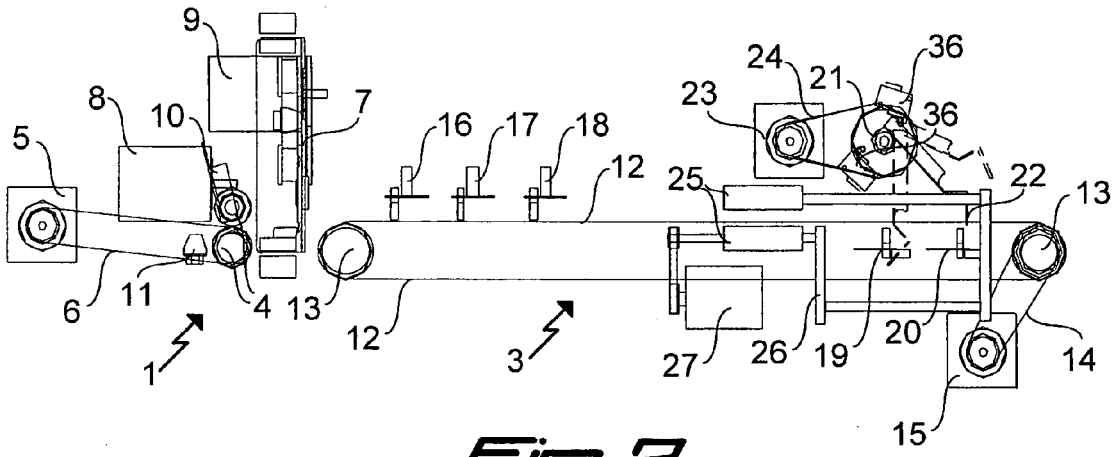
FIG. 2 shows a schematic side view of the apparatus of FIG. 1.

In FIG. 2 it is also seen that one or more microswitches 36 sending signals to the electronic calculation means of the conveying device 3 can be arranged around the rotating bar 21 to precisely determine the rotation angle of the same bar, and consequently of stops 22. The perpendicular and parallel positions of stops 22 are shown with broken lines.

Figure 3:
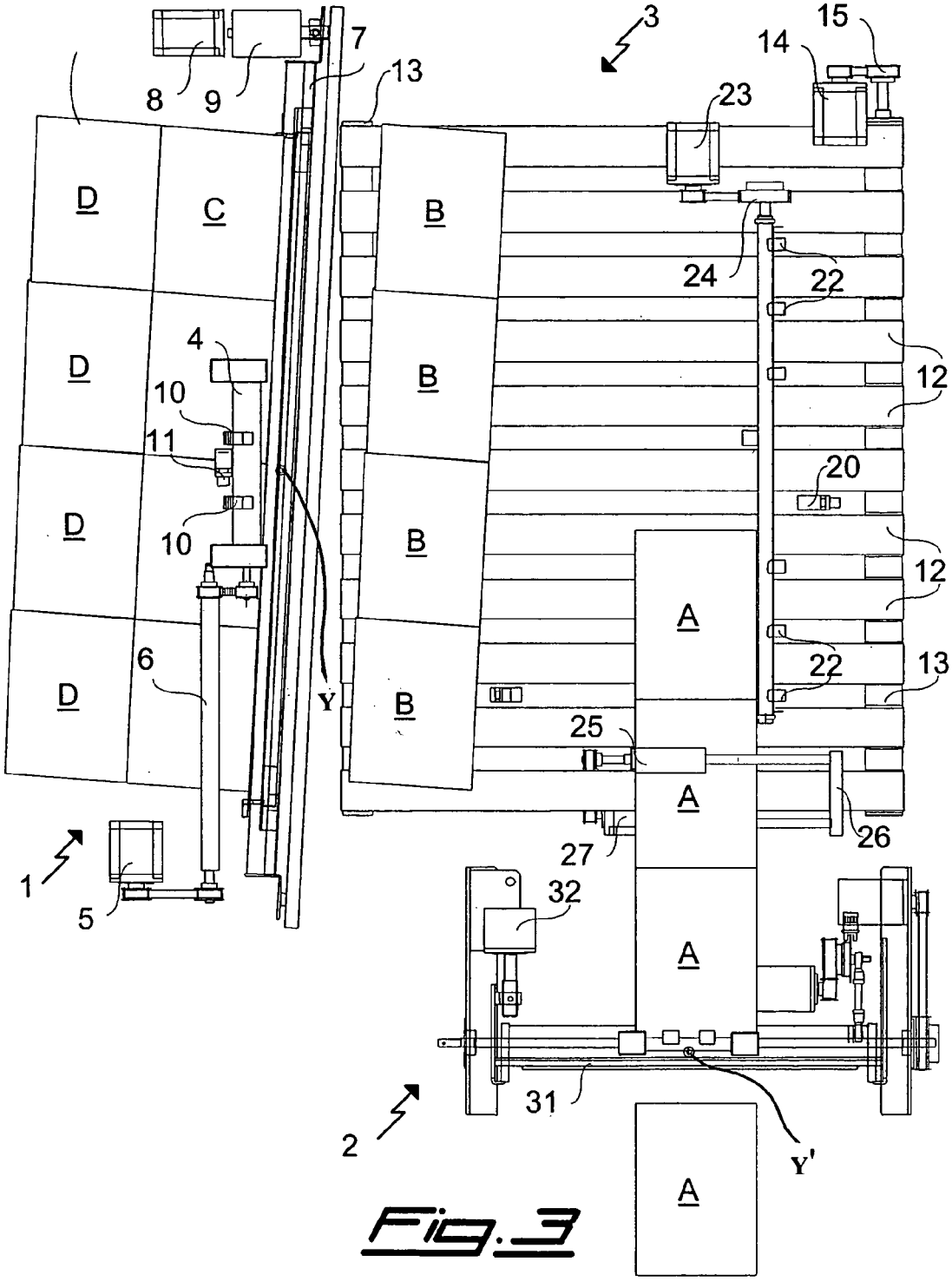
FIG. 3 shows a schematic top view of the apparatus of FIG. 1 during the use.

Referring now to FIG. 3, it is seen that during the use, a sheet comprising a plurality of images A, B, C, D arranged along several rows and columns is inserted, also slightly slantwise, in the cutting device 1, which provides for automatically rotating the cutting mechanism 7 for precisely cutting portions of said sheet along the edges of the columns of images, thanks to the marks printed between said rows and columns. In the figure, the sheet portion containing the column of images B has been just cut by the cutting device 1 and is at the beginning of the conveyor belts 12, while the portion containing the column of images A is in the cutting device 2.

If sensors 16 and 18 were simultaneously obscured, the sheet portion to be cut in the cutting device 2 would be too big to be inserted therein, so that stops 22 would be lifted and this portion would have been ejected by belts 12 from the side of the conveying device 3 opposite to the cutting device 1. Instead, if sensors 17 and 18 were simultaneously obscured, but sensor 16 were not obscured, stops 22 would be slanted of 45° for stopping a large sheet portion. Finally, if only sensor 18 were obscured, stops 22 would be arranged vertically for stopping a smaller sheet portion, such as the one containing the column of images A and shown in the figure. The latter portion, stopped by stops 22, is lifted, taken and conveyed by rollers 25 into the cutting device 2, which provides for cutting each image A of the column after orienting the cutting mechanism 31, if this were necessary.

Possible modifications and/or additions may be made by those skilled in the art to the invention embodiment hereinabove described and illustrated while remaining within the scope of the same invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. Apparatus for automatically trimming and cutting images on support sheets, which comprises two cutting devices arranged upstream and downstream, respectively, a conveying device suitable for conveying to the second cutting device the sheet portions cut by the first cutting device, wherein the conveying device comprises one or more conveyor belts tight between a pair of rollers, at least one being mechanically connected to a motor, a plurality of sensors suitable for detecting the presence of a sheet portion on the conveyor belts, as well as one or more conveying rollers suitable for taking a sheet portion placed on the conveyor belts and conveying it to the second cutting device, wherein the first and/or second cutting devices comprise a cutting mechanism, which is pivotable for rotation around a vertical axis, and wherein the first cutting device comprises one or more further conveying rollers for conveying a sheet to be cut to the cutting mechanism, which is pivoted for rotating according to control signals obtained by means of at least one pair of further sensors suitable for locating one or more marks printed on the sheet to be cut, so as to arrange the cutting mechanism parallel to the cut lines.

2. Apparatus according to claim 1, wherein the second cutting device comprises one or more further conveying rollers for conveying a sheet portion to be cut to the cutting mechanism, which is pivoted for rotating according to control signals obtained by means of at least one pair of further sensors suitable for locating one or more marks printed on the sheet portion to be cut, so as to arrange the cutting mechanism parallel to the cut lines.

3. Apparatus according to claim 2, wherein the marks comprise barcodes printed with bars parallel to the cut lines and the said further sensors of the second cutting device are suitable for locating the barcodes.

4. Apparatus according to claim 2, wherein the second cutting device is provided with encoders suitable for detecting and correcting on the cutting mechanism possible displacements of the sheet portion to be cut after the said further sensors have detected the marks thereon.

5. Apparatus according to claim 2, wherein the second cutting device is provided with another further sensor arranged close to the said further conveying rollers thereof for detecting the presence of the sheet portion to be cut.

6. Apparatus according to claim 1, wherein the marks comprise barcodes printed with bars parallel to the cut lines and the said further sensors of the first cutting device are suitable for locating the barcodes.

7. Apparatus according to claim 1, wherein the first cutting device is provided with encoders suitable for detecting and correcting on the cutting mechanism possible displacements of the sheet to be cut after the said further sensors have detected the marks thereon.

8. Apparatus according to claim 1, wherein the first cutting device is provided with another further sensor arranged close to the said further conveying rollers thereof for detecting the presence of the sheet to be cut.

* * * * *